US010297219B2

(12) United States Patent
Zhang et al.

(10) Patent No.: US 10,297,219 B2
(45) Date of Patent: May 21, 2019

(54) GOA CIRCUITS USED FOR SWITCHING DISPLAY ON A SCREEN OR ON TWO SCREENS AND DRIVING METHOD THEREOF

(71) Applicants: Shenzhen China Star Optoelectronics Technology Co., Ltd., Shenzhen, Guangdong (CN); Wuhan China Star Optoelectronics Technology Co., Ltd., Wuhan, Hubei (CN)

(72) Inventors: Zhou Zhang, Guangdong (CN); Yu-cheng Tsai, Guangdong (CN); Changwen Ma, Guangdong (CN); Pan Xu, Guangdong (CN)

(73) Assignees: Shenzhen China Star Optoelectronics Technology Co., Ltd, Shenzhen, Guangdong (CN); Wuhan China Star Optoelectronics Technology Co., Ltd, Wuhan, Hubei (CN)

( * ) Notice: Subject to any disclaimer, the term of this patent is extended or adjusted under 35 U.S.C. 154(b) by 189 days.

(21) Appl. No.: 15/308,360

(22) PCT Filed: Sep. 18, 2016

(86) PCT No.: PCT/CN2016/099172
§ 371 (c)(1),
(2) Date: Nov. 1, 2016

(87) PCT Pub. No.: WO2018/010293
PCT Pub. Date: Jan. 18, 2018

(65) Prior Publication Data

US 2018/0226037 A1 Aug. 9, 2018

(30) Foreign Application Priority Data

Jul. 13, 2016 (CN) ..... 2016 1 0552798

(51) Int. Cl.
*G09G 3/32* (2016.01)
*G09G 3/36* (2006.01)

(52) U.S. Cl.
CPC ..... *G09G 3/3666* (2013.01); *G09G 3/32* (2013.01); *G09G 3/3677* (2013.01); *G09G 2300/0408* (2013.01); *G09G 2310/0286* (2013.01)

(58) Field of Classification Search
CPC ..... G09G 3/3666; G09G 3/32; G09G 3/3677
See application file for complete search history.

(56) References Cited

U.S. PATENT DOCUMENTS

2010/0128019 A1 5/2010 Harada
2016/0358574 A1* 12/2016 Hohjoh ..... G09G 3/3614
2018/0068628 A1* 3/2018 Xiao ..... G09G 3/3677

FOREIGN PATENT DOCUMENTS

CN 1885379 A 12/2006
CN 103680439 A 3/2014
(Continued)

*Primary Examiner* — Charles V Hicks
(74) *Attorney, Agent, or Firm* — Andrew C. Cheng

(57) ABSTRACT

The disclosure provides GOA circuits used for switching display on a screen or on two screens and a driving method thereof. The GOA circuits include first GOA circuits on two sides of a main screen to control display of the main screen, second GOA circuits on two sides of the secondary screen to control display of the secondary screen, a first group of GOA control signals, controlling signal output of the first GOA circuits, a second group of GOA control signals, controlling signal output of the second GOA circuits, a switch controller, connecting the first GOA circuits and the second GOA circuits, and controlling connection or disconnection of the first group of GOA control signals and the second group of GOA control signals respectively.

8 Claims, 7 Drawing Sheets

(56) References Cited

FOREIGN PATENT DOCUMENTS

| | | | |
|---|---|---|---|
| CN | 104835441 | A | 8/2015 |
| KR | 20040024915 | A | 3/2004 |

* cited by examiner

GOA CIRCUITS USED FOR SWITCHING DISPLAY ON A SCREEN OR ON TWO SCREENS AND DRIVING METHOD THEREOF

TECHNICAL FIELD

The disclosure relates to gate driver on array (GOA) circuits used for switching display on a screen or on two screens and a driving method thereof.

DESCRIPTION OF RELATED ART

Functions loaded on a smart phone and a tablet are increasing with the development of the smart phone and the tablet, an effect of displaying on one screen cannot meet requirements of a user in many fields, so that displaying on two screens or multiple screens are necessary to satisfy requirements for improving visual effects.

At present, a conventional mobile phone with multiple screens includes more than two screens, and a control circuit connected with the screens includes at least one analog switch, the analog switch is utilized to turn one path of input signal into two paths for output, so as to drive the multiple screens. However, the mobile phone with multiple screens needs to be set with multiple screens and analog switches, which can increase difficulty in design and costs, and when it needs to be switched to one screen display, boundaries easily appear on edges of the multiple screens to harm fluency of images.

SUMMARY

Therefore, a display technique capable of displaying multiple images on one screen (or achieving multi-screen display) and switching display on one screen or on two screens smoothly with relatively simple technology and lower costs is required.

An objective of the disclosure is to provide GOA circuits that can switch display on one screen or on two screens and a driving method thereof.

In order to achieve the objective above, the GOA circuits used for switching display on one screen or on two screens are provided, the GOA circuits include first GOA circuits on two sides of a main screen to control display of the main screen, second GOA circuits on two sides of a secondary screen to control display of the secondary screen, a first group of GOA control signals, controlling signal output of the first GOA circuits, a second group of GOA control signals, controlling signal output of the second GOA circuits, and a switch controller, connected with the first GOA circuits and the second GOA circuits, and controlling connection or disconnection of the first group of GOA control signals and the second group of GOA control signals respectively.

According to an exemplary embodiment of the disclosure, the first group of GOA control signals include a first scanning trigger signal and a plurality of clock signals, the second group of GOA control signals include a second scanning trigger signal and a plurality of clock signals.

According to an exemplary embodiment of the disclosure, the first GOA circuits and the second GOA circuits include a plurality of cascaded transistor modules respectively.

According to an exemplary embodiment of the disclosure, each of the transistor modules includes a plurality of transistors.

According to an exemplary embodiment of the disclosure, the switch controller includes a GOA signal switch collection, a GOA line connection switch collection and a scanning trigger switch collection respectively with a plurality groups of switches.

According to an exemplary embodiment of the disclosure, the GOA signal switch collection includes a first group of GOA signal switches, configured to control connection and disconnection of the first group of GOA control signals, and a second group of GOA signal switches, configured to control connection and disconnection of the second group of GOA control signals.

According to an exemplary embodiment of the disclosure, the GOA line connection switch collection includes two groups of connection switches, connected with the first GOA circuits and the second GOA circuits.

According to an exemplary embodiment of the disclosure, the scanning trigger switch collection includes a first group of scanning trigger switches and a second group of scanning trigger switches.

According to an exemplary embodiment of the disclosure, a driving method of the GOA circuits used for switching display on one screen or on two screens is provided, when the main screen displays alone, the GOA circuits are controlled to output the first group of GOA control signals regularly, the second group of GOA control signals will not be output, and a first group of scanning trigger switches are turned on. When the secondary screen displays alone, the GOA circuits are controlled, the first group of GOA control signal will not be output, the second group of GOA control signals are output regularly, a second group of scanning trigger switches are turned on, and a second group of GOA signal switches are turned on. When the main screen and the secondary screen display separately, the GOA circuits are controlled to output the first group of GOA control signals and the second groups of GOA control signals regularly, the second group of GOA signal switches are turned on, and two groups of switches in a scanning trigger switch collection are respectively turned on. When the main screen and the secondary screen are combined to display as a single screen, the GOA circuits are controlled, the first group of GOA control signals are output regularly, the second group of GOA control signals will not be output, and two groups of switches in a GOA line connection switch collection are turned on.

According to an exemplary embodiment of the disclosure, a GOA circuit used for switching display on one screen or on a plurality of screens is provided, including a plurality of groups of GOA sub-circuits, including three or more groups of GOA sub-circuits, the GOA sub-circuits in one group are on two sides of a screen and controlling display of a connected screen region, a plurality groups of GOA control signals, including three or more groups of GOA control signals, controlling signal output of each of the groups of GOA sub-circuits; and a switch controller, connected with two groups of adjacent GOA sub-circuits, and controlling connection or disconnection of the plurality groups of GOA control signals respectively.

BRIEF DESCRIPTION OF THE DRAWINGS

According to description with exemplary figures, features and advantages of embodiments of the disclosure will be clearer.

DETAILED DESCRIPTION OF PREFERRED EMBODIMENTS

Embodiments of the disclosure will be described in detail with reference to the accompanying drawings as follows.

In the accompanying drawings, thicknesses of a layer, a film, a panel and a region are exaggerated for clarification. A same label represents a same component in the entire embodiments. It can be understood that when a component of a layer, a film, a region or a base is referred to "on" another component, the component can be directly on the other component, or an intermediated component can exist. Optionally, when a component is "directly on" another component, no intermediated component will exist.

Advantages and features of the disclosure as well as processes will be clear by referring to exemplary embodiments and figures to be described in detail as follows. However, the disclosure is not limited to the disclosed exemplary embodiments, the disclosure can be achieved in various forms.

Figure 1:
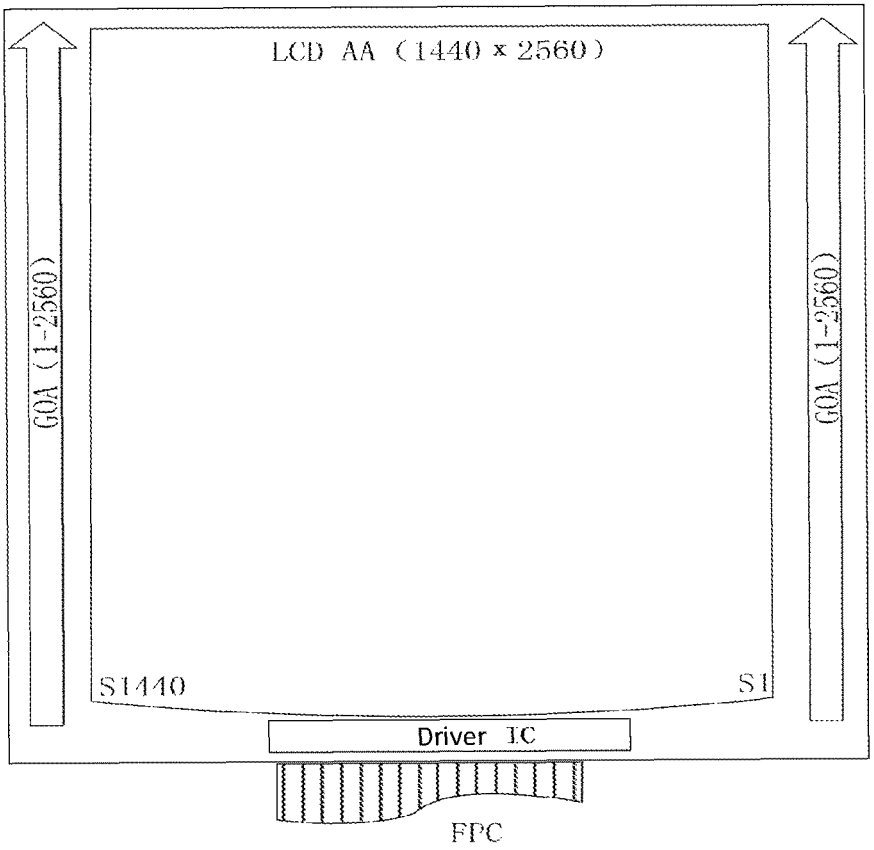
FIG. 1 (Related art)
FIG. 1 is a planer view of a LCD display architecture based on GOA circuits according to the prior art.

FIG. 1 is a planer view of a LCD display architecture based on GOA circuits according to the prior art.

Referring to FIG. 1, the LCD display architecture based on GOA circuits according to the prior art includes a screen (e.g. a LCD screen), GOA circuits on left and right sides of the screen, and a driver IC below the screen. The GOA circuits and the driver IC are all printed on a flexible printed circuit (FPC).

Exemplarily, pixels of the screen can be arranged as horizontal 1440 pixels×vertical 2560 pixels, in other words, an image resolution is 1440×2560, the pixel resolution of the screen is not limited as such, which can be set up according to requirements. The GOA circuits arranged on left and right sides of the screen are connected with each of the pixels of the screen to control driving of the pixels from the first row to the 2560th row in the screen from bottom to top sequentially.

Figure 2:
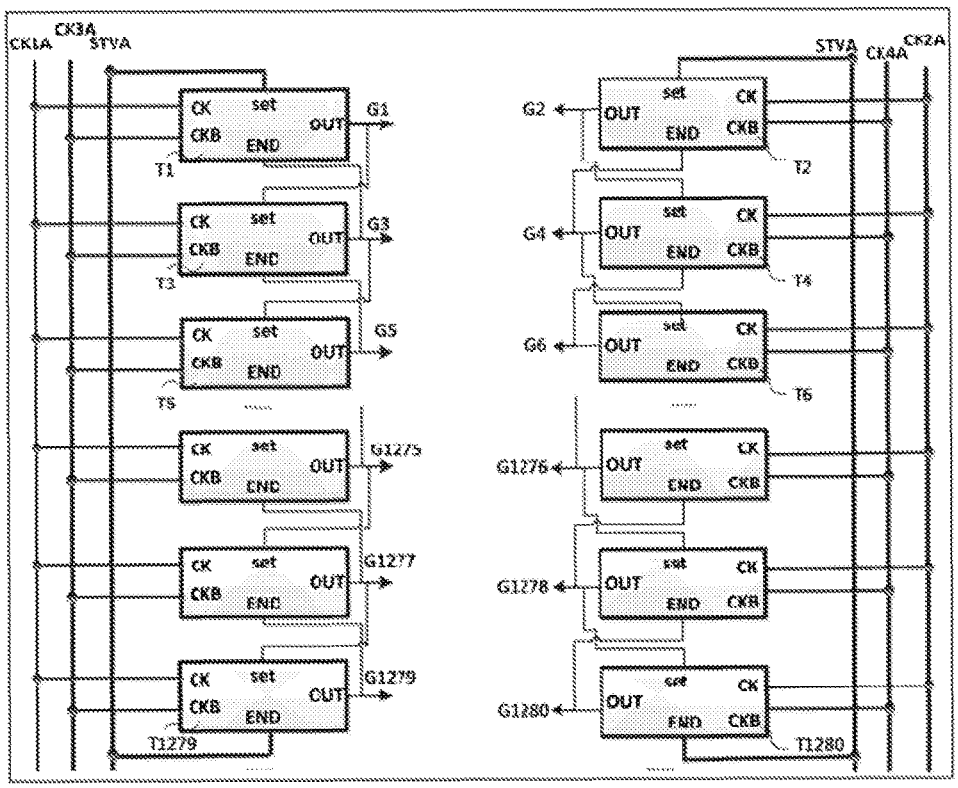
FIG. 2 (Related art)
FIG. 2 is a local structural view of the GOA circuits shown in FIG. 1.

FIG. 2 is a local structural view of the GOA circuits shown in FIG. 1.

The GOA circuits include a group of GOA control signals (e.g. including a scanning trigger signal STVA and clock signals CK1A~CK4A) and a plurality of cascaded GOA circuit collections. The GOA circuits are arranged on two sides of the screen, the GOA circuit on the left side controls driving of even-numbered gate lines, the GOA circuit on the right side controls driving of odd-numbered gate lines, the arrangement of circuits on both sides can reduce the thickness of regions arranged with circuits on the two sides.

Each of the GOA circuit collections can consist of a plurality of transistors of an identical type or various types and other circuit components, which can also be called a TFT module. A common GOA circuit includes following types: a GOA circuit based on a P type thin film transistor, a GOA circuit based on CMOS and a GOA circuit based on an N type thin film transistor, etc. The TFT module turned on with a high level voltage is taken as an example, but it is not limited as such, which can also be adapted in a circuit of the TFT module turned on with a low level voltage.

The pixels in each row from the $1^{st}$ row to the 2560th row are connected to corresponding gate lines respectively, and the corresponding gate lines drive the pixels in the row, for instance, the pixels in the first row (not shown) are connected to a first gate line GATE_1 (outputting a scanning signal G1), the pixels in the second row (not shown) are connected to a second gate line GATE_2 (outputting a scanning signal G2), and so on. In the screen shown in FIG. 1, the gate lines are arranged alternately from bottom to top on the two sides of the screen in a sequence of GATE_1~GATE_2560. When the GOA circuits in FIG. 2 are arranged in the screen of FIG. 1, the circuit diagram needs to be rotated through 180 degrees to arrange the gate lines GATE_1~GATE_2560 on the two sides of the screen with the sequence from bottom to top.

As shown in FIG. 2, an input terminal of each of the TFT modules (CK or CKB) is connected to a clock signal, an output terminal (OUT) of which is connected to a gate terminal (a set terminal or an end terminal) of the a TXT module. As the GOA circuit on the left shown in FIG. 2, a first TFT module on the left (e.g. T1 module) receives the scanning trigger signal STVA, when the STVA is a high level voltage, the T1 module is turned on, and the clock signal CK1A (or CK3A) is input in the T1 module, then the T1 module outputs the scanning signal G1 identical to the clock signal CK1A (or CK3A), and the scanning signal G1 is output to the gate terminal (set terminal) of a next connected TFT module (e.g. a T3 module), configured to control the next TFT module to be turned on or off, therefore, the pixels in corresponding rows are provided with the scanning signals G1~G(2K−1) (e.g. K is an integral and 1280≥K≥1) in sequence from the first TFT module (e.g. the T1 module) to the last module on the left. Identically, according to the method above, the scanning signals G(2K−1)~G1 can also be provided to the corresponding pixels in sequence from the last TFT module to the first TFT module. Identically, when the GOA circuit on the right is driven, the driving method is same with the driving method on the left, the pixels in corresponding rows are provided with scanning signals G2~G2K (K is an integral and 1280≥K≥1) in sequence from the first TFT module (e.g. a T2 module) to the last module (e.g. a T2K module) on the right side, or the scanning signals G2K~G2 are provided to the pixels in corresponding rows in sequence from the last TFT module to the first TFT module on the right side.

Figure 3:
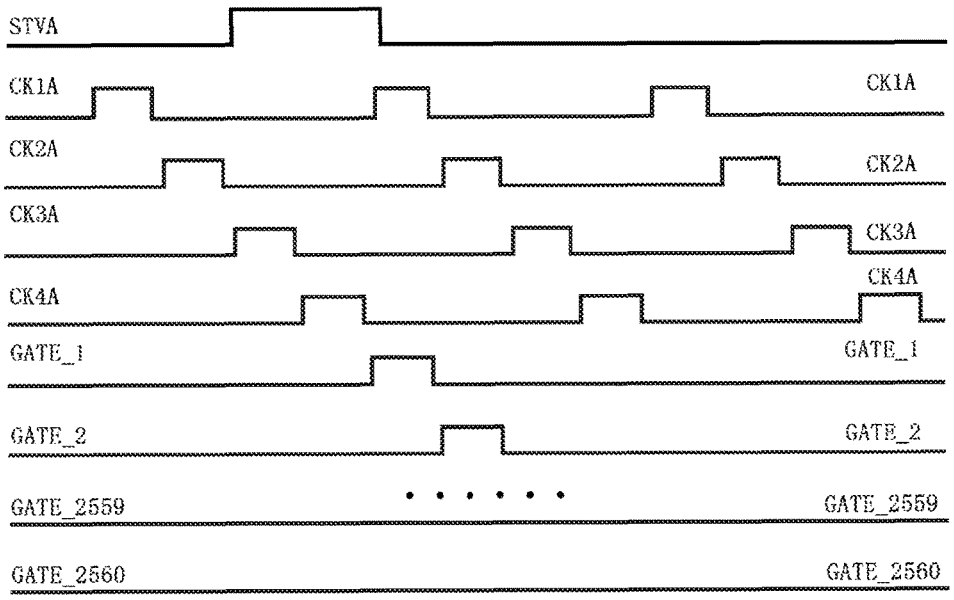
FIG. 3 (Related art)
FIG. 3 is a signal sequence diagram of the GOA circuits shown in FIG. 2.

FIG. 3 is a signal sequence diagram of the GOA circuits shown in FIG. 2. STV is a scanning trigger signal, CK1~CK4 are clock signals input in different TFT modules, an output signal of the nth gate line GATE_N is GN.

Aiming at the GOA circuit on the left side, the signal of GATE_1 is taken as an example, when the scanning trigger signal STVA is a low level voltage, a crystal module is turned off, all the scanning signals GN are the low level voltage. When the scanning trigger signal STVA is a high level voltage, the first TFT module on the left side (e.g. the T1 module) is turned on, the TFT module outputs the received clock signal CK1A (or CK3A) to be the scanning signal G1, in other words, the output scanning signal G1 after turning on the T1 module and the clock signal CK1A (CK3A) are synchronous, as the signal sequence diagram of the gate line GATE_1 shown in FIG. 3. When the scanning signal G1 output from the T1 module is the high level voltage, the next connected TFT module (e.g. the T3 module) is turned on, the T3 module outputs the received clock signal CK1A (or CK3A) to be a scanning signal G3, that is, the output scanning signal G3 after turning on the T3 module and the clock signal CK1A (CK3A) are synchronous (not shown in FIG. 3).

Identically, to the GOA circuit on the right side, when the scanning trigger signal STVA is the high level voltage, the first TFT module on the right side (e.g. the T2 module) is turned on, that is, the output scanning signal G2 after turning on the T2 module and the clock signal CK2A (or CK4A) are synchronous, as the signal sequence diagram of the gate line GATE_2 shown in FIG. 3. When the scanning signal G2 output from the T2 module is the high level voltage, the next connected TFT module (e.g. the T4 module) is turned on, and so on.

The conventional LCD screen based on GOA circuits can merely display on a single screen rather than on two screens or even multiple screens. The GOA circuits according to the disclosure add a group of GOA control signals and a switch controller including groups of switches to solve the problem above, that is, the GOA circuits according to the disclosure control display of two screens by two groups of GOA control signals respectively, and switch the two screens by switching the controller, so as to achieve switch display on one screen or on two screens. The structure will be described in detail as follows.

Figure 4:
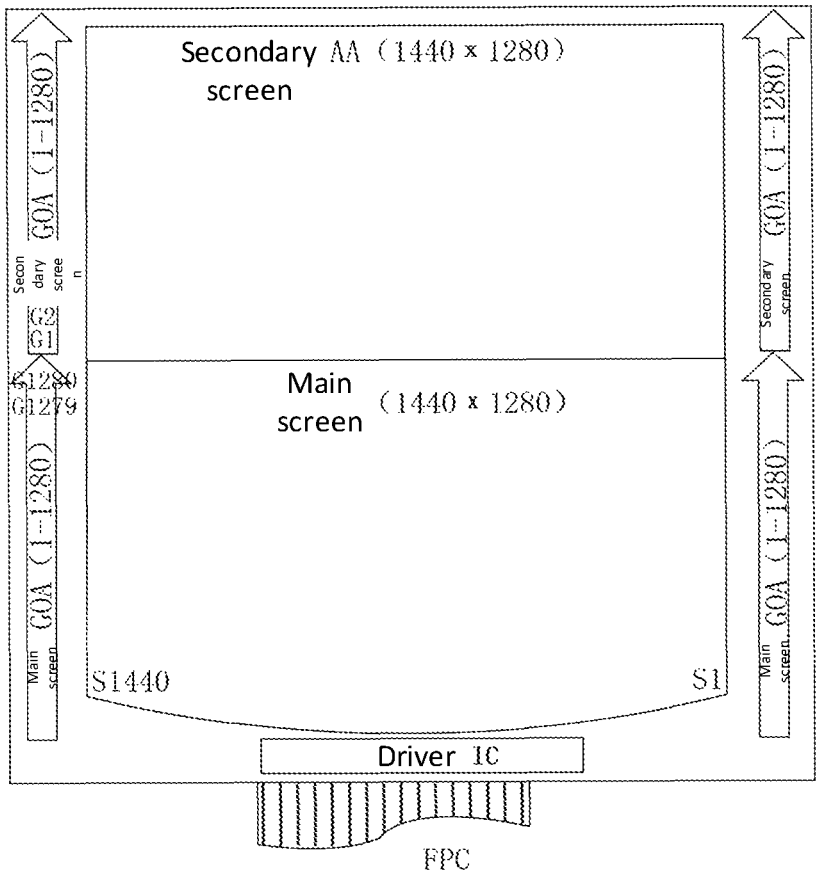
FIG. 4 is a view of a LCD display architecture based on GOA circuits according to an exemplary embodiment of the disclosure.

FIG. 4 is a view of a LCD display architecture based on GOA circuits according to an exemplary embodiment of the disclosure.

The LCD display architecture according to the exemplary embodiment includes a main screen, a secondary screen, main screen GOA circuits on left and right sides of the main screen, secondary screen GOA circuits on left and right sides of the secondary screen, and a driver IC below the entire screens. The main screen GOA circuits, the secondary screen GOA circuits and the driver IC are all printed on a flexible printed circuit (FPC).

In the disclosure, a pixel resolution of the screen can be set randomly as R×2N, where R>0, N is any odd number larger than 0. In the exemplary embodiment, the image resolution of the entire screens being 1440×2560 is taken as an example, but the disclosure is not limited as such. As shown in FIG. 4, the screen is exemplarily divided into two parts, the higher part is the secondary screen with an image resolution of horizontal R pixels×vertical N pixels (e.g. 1440×1280). The lower part is the main screen with an image resolution of horizontal R pixels×vertical N pixels (e.g. 1440×1280). Correspondingly, another group of GOA control signals and multiple groups of switches are added. One group of switches control the STV signals and the clock signal CK of the secondary screen GOA circuits, other groups of switches are set in the middle of the GOA circuits on the left and right sides respectively, configured to control connection of the last two GATE signals of the main screen and the first as well as the second GATE signals of the secondary screen, a specific GOA circuit diagram will be described in detail with reference to FIG. 5. The GOA circuits on the two sides of the main screen can control display of the main screen, the GOA circuits on the two sides of the secondary screen control display of the secondary screen accordingly.

Positions and a display ratio of the main screen and the secondary screen are merely exemplary, the positions of the two can be switched, the ratio of the two can be set up according to requirements, and the screen can be divided into two or more display regions by a similar method according to requirements, and the GOA circuits on two sides are set correspondingly to achieve control and switch display on one screen, two screens or multiple screens.

In the screen of FIG. 4, similarly to the arrangement of gate lines in FIG. 1, the gate lines are arranged alternately from bottom to top on the two sides of the screen in a sequence of GATE_1~GATE_2N (N is an odd number, for instance, N=1280). That is, the gate lines of the GOA circuits on the two sides of the main screen are GATE_1~GATE_N from bottom to top in sequence (e.g. GATE_1~GATE_1280), output scanning signals G1-GN control display of the main screen. The gate lines of the GOA circuits on the two sides of the secondary screen are GATE_(N+1)~GATE_2N from bottom to top in sequence (e.g. GATE_1281~GATE_2560), output scanning signals G(N+1)~G2N control display of the main screen, to the secondary screen alone, the gate lines can also be called GATE_1~GATE_N.

Figure 5:
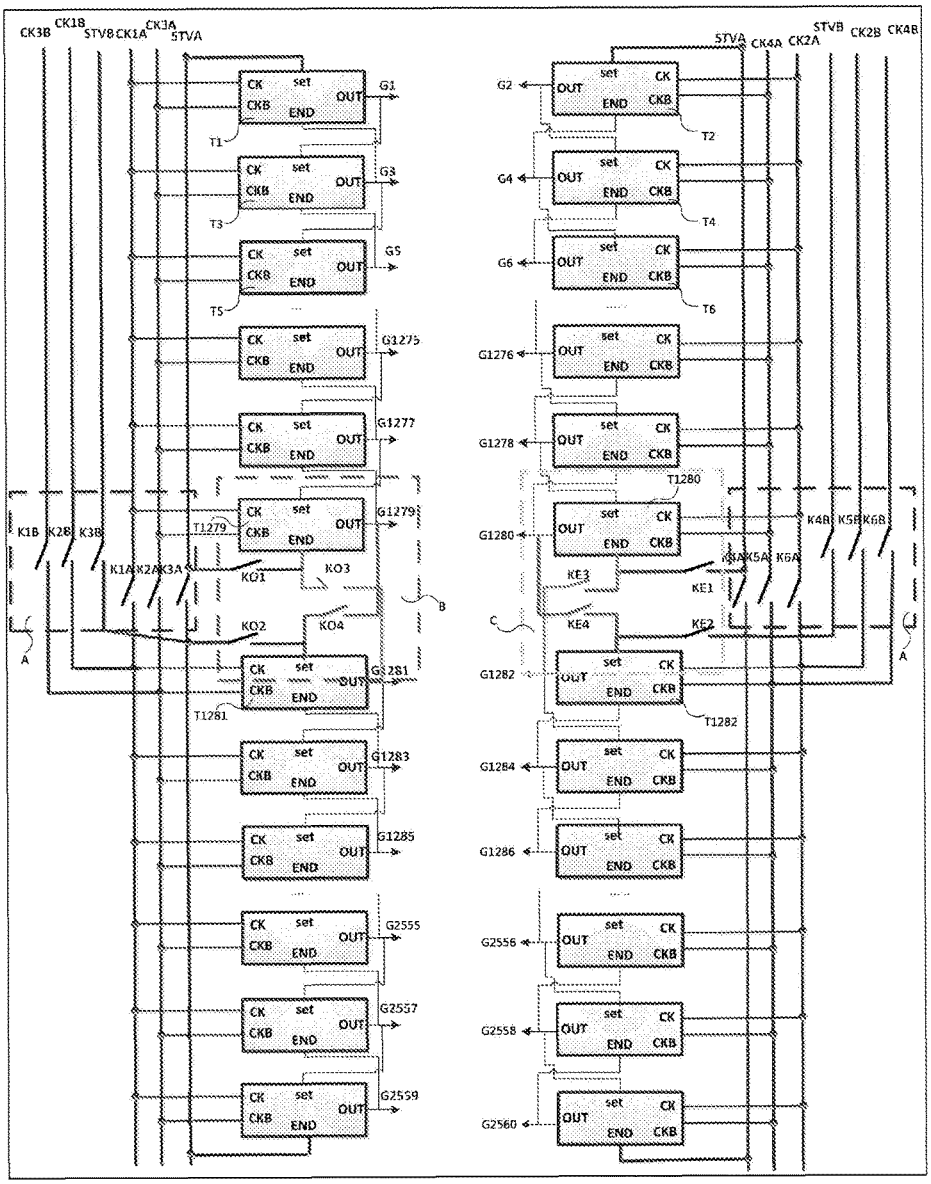
FIG. 5 is a structural view of GOA circuits with additional switches and signal groups according to an embodiment of the disclosure.

FIG. 5 is a structural view of GOA circuits with additional switches and signal groups according to an embodiment of the disclosure.

In the exemplary embodiment, the GOA circuits shown in FIG. 5 are similar to the GOA circuits shown in FIG. 2, the GOA circuits are arranged on two sides of the screen, the GOA circuit on the left side controls driving of even-numbered gate lines, the GOA circuit on the right side controls driving of odd-numbered gate lines, moreover, the GOA circuits according to the exemplary embodiment of the disclosure add a group of GOA control signals and a switch controller including multiple groups of switches. Similarly to FIG. 2, when the GOA circuits in FIG. 5 are arranged in the screen of FIG. 4, the circuit diagram needs to be rotated through 180 degrees to arrange the output scanning signals G1~G2N (N is an odd number, for instance, N=1280) on the two sides of the screen in sequence from bottom to top.

To avoid repeating, a part of the GOA circuits identical to that in FIG. 2 will not be described, only a part of the GOA circuit structure different from that in FIG. 2 will be described.

Compared with FIG. 2, the GOA circuits shown in FIG. 5 add a group of GOA control signals (including a scanning trigger signal STVB and clock signals CK1B~CK4B), and a switch controller including switch groups A, B and C.

The GOA on the left side is taken as an example, the scanning trigger signal STVB and two clock signals CK1B and CK3B (or CK2B and CK4B), the switch groups A and B are added. Specifically, in the middle of the last TFT module (a T(N−1) module, for instance, T1279 module) of the main screen and the first TFT module (a T(N+1) module, for instance, T1281 module) of the secondary screen, signal lines of the clock signals CK1A and CK3A as well as the scanning trigger signal STVA are added with switches K1A, K2A and K3A. Identically, in the middle position (the middle of T(N−1) module and T(N+1) module), the signal line of STVB is connected to the signal line of STVA, the signal line of CK1B is connected to the signal line of CK1A, the signal line of CK3B is connected to the signal line of CK3A, signal lines of CK3B, CK1B and STVB are added on switches K1B, K2B and K3B. In other embodiments, the signal lines of STVB, CK1B and CK3B can be arranged separately instead of connecting with the signal lines of STVA, CK1A and CK3A. The switch group A includes K1A, K2A, K3A, K1B, K2B and K3B that can be called a GOA signal switch collection.

The switch group B includes following arranged switches, a switch KO1 is added between an end terminal of the last TFT module (a T(N−1) module, for instance, T1279 module) of the main screen and a line connected with the STVA signal line, similarly, a switch KO2 is added on a line connecting a junction of the STVA signal line and the STVB signal line and a set terminal of the first TFT module (a T(N+1) module, for instance, T1281 module) of the secondary screen. Moreover, a switch KO3 is added on a line connecting the output terminal OUT of T(N+1) (e.g. T1281 module) and the end terminal of T(N−1) (e.g. T1279 terminal), a switch KO4 is added on a line connecting the output terminal OUT of T(N−1) (e.g. T1279 module) and the set terminal of T(N+1) (e.g. T1281 module). The switch group B includes KO1, KO2, KO3 and KO4, which can be called even-numbered line switches.

The arrangement of the GOA circuit on the right side is similar with the arrangement of the GOA circuit on the left side. That is, signal lines of STVB, CK2B and CK4B are connected to the signal lines of STVA, CK2A and CK4A respectively, in the middle of the GOA circuits, which is in the middle of the last TFT module (a TN module, for instance, T1280 module) of the main screen and the first TFT module (a T(N+2) module, for instance, T1282 module) of the secondary screen, switches K4A, K5A, K6A, K4B, K5B and K6B are added on the signal lines of STVA, CK4A and CK2A as well as the signal lines of STVB, CK2B and CK4B respectively, and the added switches can be called as GOA signal switches. The switch group C includes following arranged switches, a switch KE1 is added on a line connecting the end terminal of the TN module (e.g. T1280 module) and the STVA signal line, similarly, a switch KE2 is added on a line connecting the junction of the STVA signal line and the STVB signal line with the set terminal of the T(N+2) module (e.g. T1282 module). Moreover, a switch KE3 is added on a line connecting the output terminal OUT of the T(N+2) module and the end terminal of the TN module, a switch KE4 is added on a line connecting the output terminal OUT of the TN module and the set terminal of the T(N+2) module. The switch group C includes KE1, KE2, KE3 and KE4, which can be called as odd-numbered line switches.

The three switch groups A, B and C can be divided into a GOA signal switch collection, a GOA line connection switch collection and a scanning trigger switch collection according to respective function in the GOA circuits. Specifically, the GOA signal switch collection includes a first switch group K1A~K6A, configured to control connection or disconnection of the signal STVA and CK1A~CK4A, and a second switch group K1B~K6B, configured to control connection or disconnection of the signal STVB and CK1B~CK4B. The GOA line connection switch collection includes KO3 and K04, configured to connect the GOA circuit on the left side of the main screen to the GOA circuit on the left side of the secondary screen, and KE3 as well as KE4, configured to connect the GOA circuit on the right side of the main screen to the GOA circuit on the right side of the secondary screen. The scanning trigger switch collection includes a first group of scanning trigger switches, which are KO1 and KE1, and a second group of scanning trigger switches, which are KO2 and KE2.

In the exemplary embodiment, according to description of FIG. 4 and FIG. 5, outputs G1~GN (N is an odd number, for instance, N=1280) of the higher part of the GOA circuit diagram shown in FIG. 4 control display of the main screen, outputs G(N+1)~G2N of the lower part of the GOA circuit diagram shown in FIG. 4 control display of the secondary screen. A method of switching display on one screen or on two screens will be described as follows.

According to the exemplary embodiment of the disclosure, when the main screen needs to display alone (or the secondary screen does not display), the scanning trigger signal STVA and the clock signals CK1A~CK4A are controlled to be output regularly, the STVB and CK1B~CK4B are unnecessary to output signals (or no output), the switches KO1 and KE1 are turned on, other switches are turned off. As the signal STVA and CK1A~CK4A are output regularly, the switches KO1 and KE1 are turned on, the signal STVA and CK1A-CK4A can control driving of T1 module~TN module (e.g. T1 module~T1280 module), the signals G1~GN (e.g. G1~G1280) are output to control display of the main screen. As the switches KO3, KO4, KE3, KE4 in the switch groups B and C are turned off, signals of the main screen cannot be transferred to the secondary screen, moreover, as the signal STVB and CK1B~CK4B are not output, the switch group A and the switches KO2 and KE2 are all turned off, no signal will be output to T(N+1) module~T2N module (e.g. T1281 module~T2560 module) of the secondary screen, so that the secondary screen displays no image.

According to the exemplary embodiment of the disclosure, when the secondary screen needs to display alone (or the main screen does not display), the scanning trigger signal STVB and the clock signals CK1B~CK4B are controlled to be output regularly, the signal STVA and CK1A~CK4A are unnecessary to be output (or no output), the switches K1B~K6B are turned on, KO2 and KE2 are turned on, other switches are all turned off. As the STVA and CK1A~CK4A have no output, the signal STVB and CK1B~CK4B are output regularly, the switches K1B~K6B and KO2 as well as KE2 are turned on, the signal STVB and CK1B~CK4B can control driving of T(N+1) module~T2N module (e.g. T1281 module~T2560 module), the signals G(N+1)~G2N (e.g. G1281~G2560) are output to control display of the secondary screen. As the switches KO3, KO4, KE3, KE4 in the switch groups B and C are turned off, signals of the secondary screen cannot be transferred to the main screen, moreover, as the signal STVA and CK1A~CK4A are not output, the switches K1A~K6A as well as KO1 and KE1 are all turned off, no signal will be output to T1 module~TN module (e.g. T1 module~T1280 module) of the main screen, so that the main screen displays nothing.

According to the exemplary embodiment of the disclosure, when the main screen and the secondary screen display separately, the STVB and CK1B~CK4B output signals regularly, meanwhile, the STVA and CK1A~CK4A output signals regularly as well, the switches K1B~K6B are turned on, KO2, KE2, KO1 and KE1 are turned on, other switches are all turned off. As the signal STVA and CK1A~CK4A output signals regularly, KO1 and KE1 are turned on, the signal STVA and CK1A~CK4A can control driving of T1 module~TN module (e.g. T1 module~T1280 module), the signals G1~GN (e.g. G1~G1280) are output to control display of the main screen. Moreover, the switches KO3, KO4, KE3, KE4 in the switch groups B and C are turned off, signals of the main screen cannot be transferred to the secondary screen, however, as the STVB and CK1B~CK4B output signals regularly, the switches K1B~K6B, KO2 and KE2 are turned on, the STVB and CK1B~CK4B signals can control driving of T(N+1) module~T2N module (e.g. T1281 module~T2560) individually, signals G(N+1)~G2N (e.g. G1281~G2560) are output to control display of the secondary screen. Accordingly, the main screen and the secondary screen are controlled by different signals respectively for displaying separately.

According to the exemplary embodiment of the disclosure, when the main screen and the secondary screen display as a whole (a single screen display), the signal STVB and CK1B~CK4B are unnecessary to be output (or on output), the signal STVA and CK1A~CK4A are output regularly, the switches K1A~K6A are turned on, KO3, KE3, KO4 and KE4 are turned on, other switches are all turned off. As the STVB and CK1B~CK4B have no output, K1B~K6B, KE1, KE2, KO1 and KO2 are all turned off, no signal will control driving of T(N+1) module~T2N module (e.g. T1281 module~T2560 module) (or the secondary screen) individually. But as the signal STVA and CK1A~CK4A are output regularly, the switches K1A~K6A, K03, KE3, KO4 and KE4 are turned on, the signal STVA and CK1A~CK4A can control driving of T1 module~TN module (e.g. T1 module~T1280), or control display of the main screen, and signals of the main screen can be transferred to the secondary screen, so that the screens can display as a whole. Which is identical to a display effect of the GOA circuits in FIG. 2, achieving a single display effect.

The disclosure is not limited as such, in other exemplary embodiments, the gate lines GATE_1~GATE_2N (N is an odd number, for instance, N=1280) can also be arranged from top to bottom of the screen, so that the outputs G1~G1280 of the higher part of the GOA circuits shown in FIG. 4 control display of the secondary screen, the outputs G(N+1)~G2N of the lower part of the GOA circuits control display of the secondary screen. Moreover, the GOA circuits according to the exemplary embodiments can scan forward and backward.

The scanning trigger signals STVA and STVB can be identical or not. The clock signals CK1A~CK4A and CK1B~CK4B can be identical or not, the clock signal line is not limited in the exemplary number and sequence diagram, which can be set up according to requirements. Correspondingly, the amount of switches controlling the clock signal line can be changed accordingly. That is, the switch groups in the switch controller in the embodiment are not limited as such, the amount and positions of the switch groups are not limited as such, which can be modified and formatted according to requirements.

Figure 6:
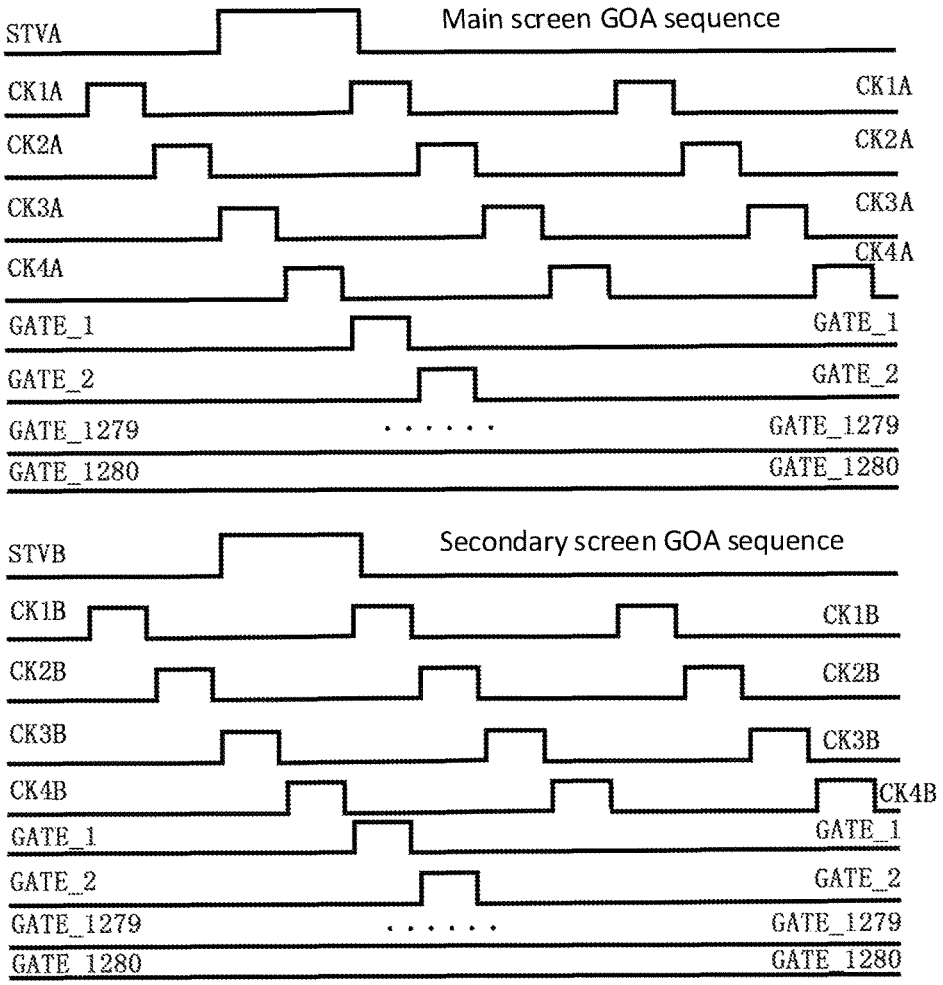
FIG. 6 is a signal sequence diagram of GOA circuits of a main screen and a secondary screen during two screens displaying separately according to an embodiment of the disclosure.

FIG. 6 is a signal sequence diagram of GOA circuits of a main screen and a secondary screen during two screens displaying separately according to an embodiment of the disclosure. The higher part in FIG. 6 is a main screen GOA sequence diagram, the lower part is a secondary screen GOA sequence diagram. The circuit is designed according to situation (3) described with reference to FIG. 5, when the main screen and the secondary screen display images separately, the signal STVA and CK1A~CK4A control signal outputs G(N+1)~GN (e.g. G1~G1280) of the main screen, the signal STVB and CK1B~CK4B control signal outputs G(N+1)~G2N (e.g. G1281~G2560) of the secondary screen.

Referring to FIG. 5, aiming at the GOA circuit on the left side of the main screen, when the scanning trigger signal STVA is a high level voltage, the first TFT module (e.g. T1 module) on the left is turned on, the T1 module outputs the received clock signal CK1A (or CK3A) to be the scanning signal G1, in other words, the output scanning signal G1 after turning on the T1 module and the clock signal CK1A (or CK3A) are synchronous, as the signal of the gate line GATE_1 in the main screen GOA sequence diagram shown in FIG. 6. When the scanning signal G1 output from the T1 module is the high level voltage, the next connected TFT module (e.g. the T3 module) is turned on, the T3 module outputs the received clock signal CK1A (or CK3A) to be the scanning signal G3, that is, the output scanning signal G3 after turning on the T3 module and the clock signal CK1A (or CK3A) are synchronous (not shown in FIG. 6). Identically, aiming at the GOA circuit on the right side of the main screen, the output scanning signal G2 from the turned on first TFT module (e.g. the T2 module) on the right and the clock signal CK2A (or CK4A) are synchronous, as the signal of the gate line GATE_2 in the main screen GOA sequence diagram shown in FIG. 6.

Referring to FIG. 5, aiming at the GOA circuit on the left side of the secondary screen, when the scanning trigger signal STVB is the high level voltage, the first TFT module (a T(N+1) module, for instance, T1281 module) on the left is turned on, the T(N+1) module outputs the received clock signal CK1B (or CK3B) to be the scanning signal G(N+1) (in the secondary screen individually, it can also be called as the signal G1 of the first gate line GATE_1), in other words, the output scanning signal G1 from the turned on T(N+1) module and the clock signal CK1A (or CK3A) are synchronous, as the signal of the gate line GATE_1 in the secondary screen GOA sequence diagram shown in FIG. 6. Identically, aiming at the GOA circuit on the right side of the secondary screen, the output scanning signal G(N+2) (in the secondary screen individually, it can also be called as the signal of the second gate line GATE_2) from the turned on first TFT module (e.g. the T(N+2) module) on the right and the clock signal CK2A (or CK4A) are synchronous, as the signal of the gate line GATE_2 in the secondary screen GOA sequence diagram shown in FIG. 6.

Figure 7:
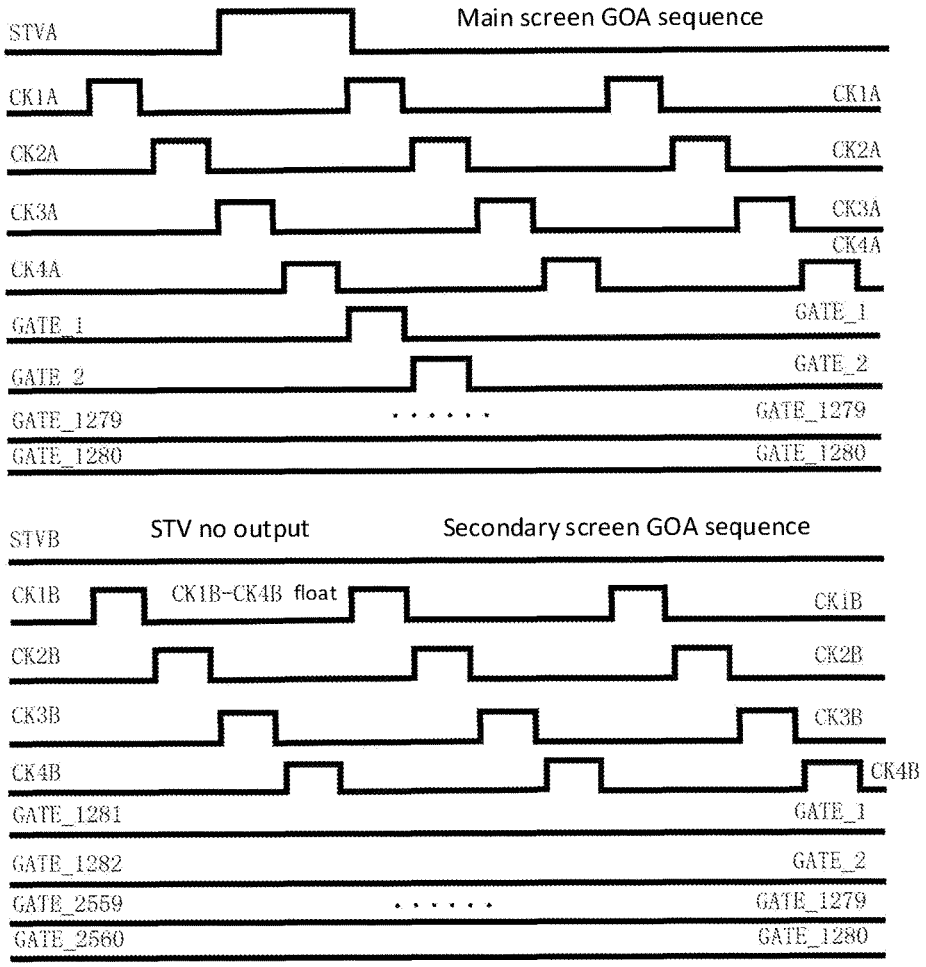
FIG. 7 is a signal sequence diagram of GOA circuits of a main screen and a secondary screen during two screens displaying as a whole according to an embodiment of the disclosure.

FIG. 7 is a signal sequence diagram of a GOA circuit of a main screen and a secondary screen during two screens displaying as a whole according to an embodiment of the disclosure. The higher part in FIG. 7 is a main screen GOA sequence diagram, the lower part is a secondary screen GOA sequence diagram. The circuit is designed according to situation (4) described with reference to FIG. 5, when the main screen and the secondary screen display an image as a whole, the signal STVB are not output, and CK1B~CK4B are not output (or floating), the signal STVA and CK1A~CK4A are output regularly and controlling signal outputs G1~GN (e.g. G1~G1280) of the main screen as well as G(N+1)~G2N (e.g. G1281~G2560) of the secondary screen. The signal output is basically identical to the process outputting signals with reference to FIG. 2 and FIG. 3, it is unnecessary to go into details.

As a display ratio of the main screen to the secondary screen can be set up limitlessly, positions of switch groups in the switch controller can be changed correspondingly, specifically, the switch groups in the switch controller can be disposed on a junction of the main screen and the secondary screen. Obviously, the screen can be divided into two or more screens as well, referring to the design of GOA circuits of the exemplary embodiment, the GOA circuits can be divided into multiple groups of GOA sub-circuits, each group of the GOA sub-circuits are on the two sides of the screen and controlling display of the connected screen. Correspondingly, multiple groups of GOA control signals are provided, configured to control signal output of each group of GOA sub-circuits. Identically, the switch controller is set to connect two adjacent groups of GOA sub-circuits, and control connection or disconnection of the multiple groups of GOA control signals respectively.

The GOA circuits used for switching display on one screen or on two screens and the driving method thereof are described above, the disclosure is not limited as such, the GOA circuits of the disclosure are modified and transformed properly with the same principle of the disclosure to achieve the GOA circuit used for switching display on one screen or on multiple screens.

The exemplary embodiments are merely for illustration rather than limitation. Although some exemplary embodiments are described, it should be understood by a person skilled in the art that the exemplary embodiments can be modified according to the protected scope of the disclosure with the same advantages and novelty. Modifications of the disclosed exemplary embodiments and other exemplary embodiments are included in the range of the claims and the equivalent.

What is claimed is:

1. GOA circuits used for switching display on a screen or on two screens, comprising:

first GOA circuits, disposed on two sides of a main screen to control display of the main screen;

second GOA circuits, disposed on two sides of a secondary screen to control display of the secondary screen;

a first group of GOA control signals, controlling signal output of the first GOA circuits;

a second group of GOA control signals, controlling signal output of the second GOA circuits; and a switch controller, connected with the first GOA circuits and the second GOA circuits, and controlling connection or disconnection of the first group of GOA control signals and the second group of GOA control signals respectively;

wherein the first GOA circuits and the second GOA circuits comprise a plurality of cascaded transistor modules respectively, and the switch controller comprises a GOA signal switch collection to control connection or disconnection of the control signals, a GOA line connection switch collection to connect the first GOA circuits to the second GOA circuits and a scanning trigger switch collection between an end terminal of the last cascaded transistor module of the first GOA circuits and a set terminal of the first cascaded transistor module of the second GOA circuits.

2. The GOA circuits according to claim 1, wherein the first group of GOA control signals comprise a first scanning trigger signal and a plurality of clock signals, the second group of GOA control signals comprise a second scanning trigger signal and a plurality of clock signals.

3. The GOA circuits according to claim 2, wherein each of the transistor modules comprises a plurality of transistors.

4. The GOA circuits according to claim 2, wherein the GOA signal switch collection comprises:

a first group of GOA signal switches, configured to control connection and disconnection of the first group of GOA control signals; and a second group of GOA signal switches, configured to control connection and disconnection of the second group of GOA control signals.

5. The GOA circuits according to claim 4, wherein the GOA line connection switch collection comprises two groups of connection switches, connected with the first GOA circuits and the second GOA circuits.

6. The GOA circuits according to claim 5, wherein the scanning trigger switch collection comprises a first group of scanning trigger switches and a second group of scanning trigger switches.

7. A GOA circuit used for switching display on a screen or on a plurality of screens, comprising:

a plurality groups of GOA sub-circuits, comprising three or more groups of GOA sub-circuits, each of the groups of GOA sub-circuits on two sides of a screen and controlling display of a connected screen region;

a plurality groups of GOA control signals, comprising three or more groups of GOA control signals, controlling signal output of each of the groups of GOA sub-circuits; and a switch controller, connected with two groups of adjacent GOA sub-circuits, and controlling connection or disconnection of the plurality groups of GOA control signals respectively;

wherein the GOA sub-circuits comprise a plurality of cascaded transistor modules respectively, and the switch controller comprises a GOA signal switch collection to control connection or disconnection of the control signals, a GOA line connection switch collection to connect one of the two groups of adjacent GOA sub-circuits to another of the two groups of adjacent GOA sub-circuits and a scanning trigger switch collection between an end terminal of the last cascaded transistor module of one of the two groups of adjacent GOA sub-circuits and a set terminal of the first cascaded transistor module of another of the two groups of adjacent GOA sub-circuits.

8. A driving method of the GOA circuits according to claim 1, when the main screen displays alone, controlling the GOA circuits to output the first group of GOA control signals regularly, no output from the second group of GOA control signals, and turning on a first group of scanning trigger switches;

when the secondary screen displays alone, controlling the GOA circuits, no output from the first group of GOA control signals, the second group of GOA control signals output regularly, turning on a second group of scanning trigger switches, and turning on a second group of GOA signal switches;

when the main screen and the secondary screen display separately, controlling the GOA circuits to output the first group of GOA control signals and the second group of GOA control signals regularly, turning on the second group of GOA signal switches, and turning on two groups of switches in a scanning trigger switch collection respectively;

when the main screen and the secondary screen are combined to display as a single screen, controlling the GOA circuits, the first group of GOA control signals output regularly, no output from the second group of GOA control signals, turning on two groups of switches in a GOA line connection switch collection.

* * * * *